US009869282B2

(12) United States Patent
Yamamoto et al.

(10) Patent No.: US 9,869,282 B2
(45) Date of Patent: Jan. 16, 2018

(54) CANISTER INSTALLATION STRUCTURE

(71) Applicant: MITSUBISHI JIDOSHA KOGYO KABUSHIKI KAISHA, Tokyo (JP)

(72) Inventors: Masahiro Yamamoto, Aichi (JP); Katsuyuki Hamada, Okazaki (JP); Kenichi Kunii, Okazaki (JP); Takayuki Sano, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/064,889

(22) Filed: Mar. 9, 2016

(65) Prior Publication Data

US 2016/0273495 A1 Sep. 22, 2016

(30) Foreign Application Priority Data

Mar. 17, 2015 (JP) ..... 2015-053626

(51) Int. Cl.
*F02M 25/08* (2006.01)

(52) U.S. Cl.
CPC ..... *F02M 25/0854* (2013.01); *F02M 25/089* (2013.01)

(58) Field of Classification Search
CPC ..... F02M 25/0854; F02M 25/089
USPC ..... 123/519
See application file for complete search history.

(56) References Cited

U.S. PATENT DOCUMENTS 4,805,581 A * 2/1989 Yamada ..... F02M 25/0854 123/519
5,195,780 A * 3/1993 Inoue ..... B60K 15/03 280/830
5,409,264 A * 4/1995 Nakatani ..... B60K 15/03504 280/784
5,687,697 A * 11/1997 Ishikawa ..... B60K 15/03504 123/520
5,702,125 A * 12/1997 Nakajima ..... B60K 15/03504 280/834
6,308,987 B1 * 10/2001 Mitake ..... B60K 15/03504 280/834
7,849,838 B2 * 12/2010 Ohhira ..... B60K 15/03504 123/519
2011/0017069 A1 * 1/2011 Murayama ..... B60K 15/03504 96/121

FOREIGN PATENT DOCUMENTS

JP 2910607 B2 6/1999
JP 5101688 B2 12/2012

* cited by examiner

*Primary Examiner* — Carlos A Rivera
*Assistant Examiner* — Anthony Taylor, Jr.
(74) *Attorney, Agent, or Firm* — Birch, Stewart, Kolasch & Birch, LLP

(57) ABSTRACT

A canister is disposed in an underfloor regions α which is surrounded by a muffler arranged under a floor panel at a rear end of a vehicle body, a rear differential gear unit arranged under the floor panel at a location adjacent to the muffler in a longitudinal direction of the vehicle body, and a rear suspension member arranged so as to cover the space between the muffler and the rear differential gear unit from the underside of the vehicle body.

3 Claims, 3 Drawing Sheets

CANISTER INSTALLATION STRUCTURE

BACKGROUND OF THE INVENTION

Field of the Invention

The present invention relates to an installation structure for a canister that adsorbs an evaporative gas within a fuel tank.

Description of the Related Art

In automobiles (motor vehicles), an evaporative gas of fuel within a fuel tank is adsorbed using a canister and the adsorbed evaporative gas is desorbed from the canister and treated so that the evaporative gas in the fuel tank may not be released into the atmosphere.

The adsorption and desorption efficiency of the canister increases with increase in the canister temperature. Usually, therefore, the canister is arranged inside an engine compartment where the interior temperature is high. However, there is a tendency for more and more evaporative gas to be treated, and it is often the case that the capacity of the canister has to be increased correspondingly. In such a case, it is difficult to install the canister inside the engine compartment because of its limited space.

Thus, in many cases, the canister is installed at the rear part of a vehicle body where the space for installation is easily available. Recently, attempts have been made to raise the temperature of the canister by utilizing the structure of the rear part of the vehicle body. For example, the canister is arranged in the space surrounded by a side member, a cross member and an exhaust pipe located at the rear part of the vehicle body, as disclosed in Japanese Patent No. 2910607, or the canister is arranged in the vicinity of a differential gear unit, as disclosed in Japanese Patent 5101686, with a view to raising the temperature of the space in which the canister is arranged.

In the case of the former structure, however, the space in which the canister is arranged is large, and also since the underside of the canister is left open, the temperature of the canister does not rise satisfactorily. The latter structure relies upon the heat from the differential gear unit (i.e., heat from the oil in the differential gear unit), so that the canister temperature does not rise satisfactorily.

SUMMARY OF THE INVENTION

An object of the present invention is to provide a canister installation structure which enables efficient increase of the temperature of a canister arranged at a rear part of a vehicle body by making use of the rear part structure of the vehicle body.

To achieve the object, the present invention provides a canister installation structure in which a canister for adsorbing an evaporative gas of fuel in a fuel tank is arranged at a rear part of a vehicle body, wherein the rear part of the vehicle body includes a muffler arranged under a floor panel at a rear end of the vehicle body, a rear differential gear unit arranged under the floor panel at a location adjacent to the muffler in a longitudinal direction of the vehicle body, and a rear suspension member arranged so as to cover a space between the muffler and the rear differential gear unit from the underside of the vehicle body, and wherein the canister is disposed in an underfloor region surrounded by the rear differential gear unit, the rear suspension member and the muffler.

According to the present invention, the canister is disposed in the limited underfloor space (region) that is covered on its front, back, bottom and lateral sides with the rear differential gear unit, the muffler and the rear suspension member. The temperature of this space readily rises due to heat from the muffler and heat from the rear differential gear unit, and in addition, heat is liable to remain in the space, so that the temperature of the canister can be efficiently raised.

Thus, by making use of the rear part structure of the vehicle body, the temperature of the canister arranged at the rear part of the vehicle body can be raised sufficiently. As a consequence, the adsorption and desorption efficiency of the canister can be heightened to a satisfactory extent. In addition, since the underside of the canister is protected by the rear suspension member that overlaps with the canister, the canister can be prevented from being damaged by chipping (flying gravel) during travel of the motor vehicle.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

The present invention will be described below with reference to FIGS. 1 to 5 illustrating an embodiment thereof.

Figure 1:
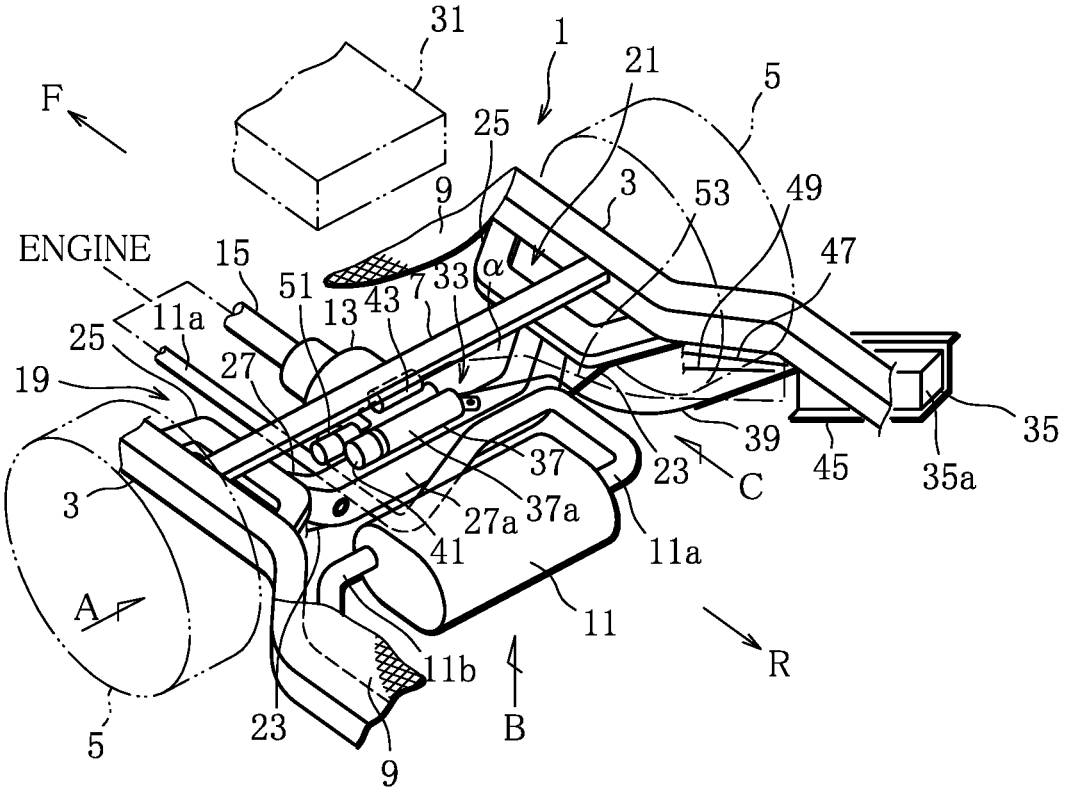
FIG. 1 is a perspective view illustrating a structure of a rear part of a vehicle body together with a canister arranged at the rear part of the vehicle body according to one embodiment of the present invention.
Figure 2:
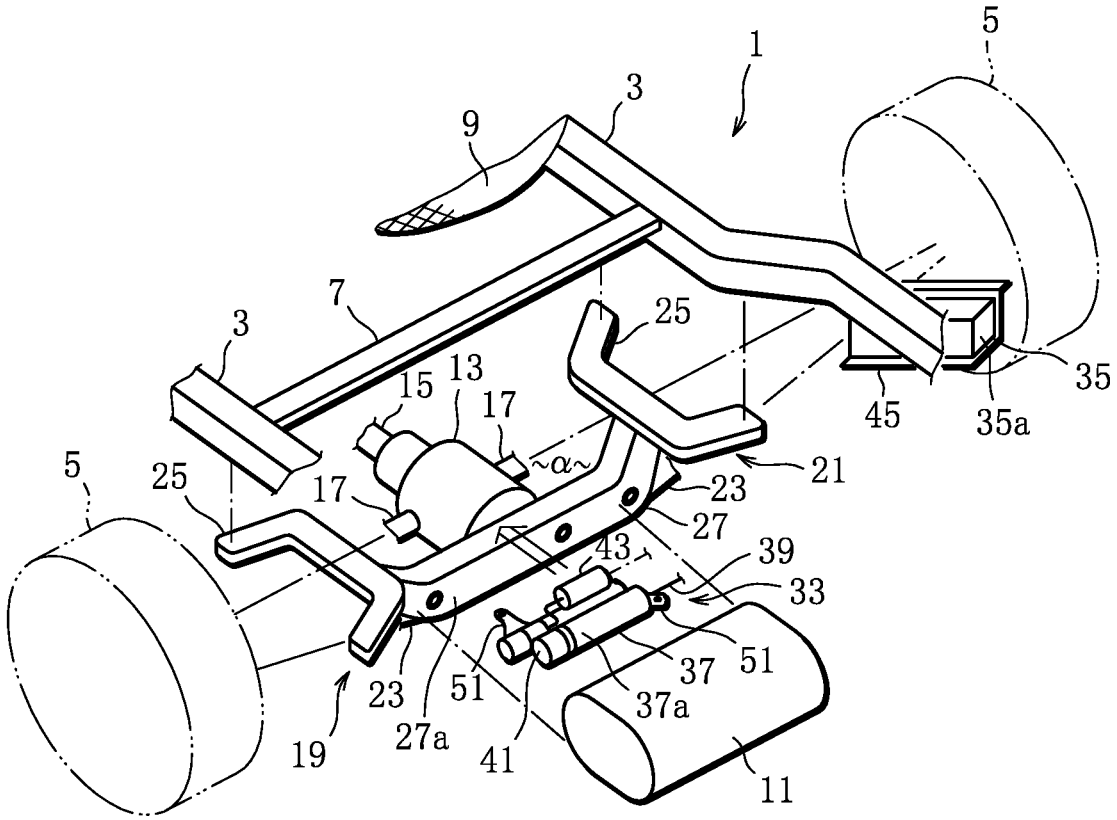
FIG. 2 is an exploded perspective view of the rear part of the vehicle body.

FIG. 1 illustrates a frame structure of a rear part of a vehicle body 1 of, for example, an automobile (motor vehicle), and FIG. 2 is an exploded perspective view showing the frame structure with part thereof disassembled. In the figure, reference sign F denotes the front of the automobile and R denotes the rear of the automobile.

The automobile is of an FR drive type, for example. To explain the frame structure of the vehicle body 1, reference sign 3 in FIGS. 1 and 2 denotes a pair of side frames extending in a longitudinal direction of the vehicle body 1. Each side frame 3 extends from the front part of the vehicle body along a front wheel (not shown) and a rear wheel 5 up to the rear part of the vehicle body where a luggage compartment is situated, for example. A cross member 7 extends between portions of the side frames 3 located close to the rear wheels 5. A floor panel 9 is placed on the upper surface of a frame constituted by the side frames 3 and the cross member 7.

A main muffler 11 (corresponding to the muffler of the present invention) is disposed along a width direction of the vehicle, namely, sideways, between rearmost end portions of the side frames 3. The main muffler 11 is located in the middle with respect to the width of the vehicle and immediately below (under) the floor panel 9. A rear differential gear unit 13 is arranged immediately below the cross member 7 which is located in front of the main muffler 1 adjacently thereto in the longitudinal direction of the vehicle body. A propeller shaft 15 (transmission shaft) extends from the front part of the rear differential gear unit 13 to an engine (not shown) arranged at the front part of the vehicle body, and output shafts 17 extend from both sides, as viewed along the width direction of the vehicle body, of the rear differential gear unit 13 to the respective rear wheels 5, so that driving force is transmitted from the engine to the rear wheels 5 arranged on both sides along the width direction of the vehicle body.

A suspension device 19 of, for example, a multi-link type, is arranged between the rear wheels 5 located at the rear end portions of the respective side frames 3. The suspension device 19 includes a sub frame 21 situated between the side frames 3. The sub frame 21 comprises, for example, a pair of, right and left C-shaped frames 25 secured to the undersides of the respective side frames 3 and a suspension cross member 27 (corresponding to the rear suspension member of the present invention) extending between the frames 25. The suspension cross member 27 has a generally C shape bent downward from opposite portions thereof attached to the respective frames 25. As illustrated in FIGS. 1 and 2 by way of example, a middle bent portion 27*a* is disposed (in a space) between the main muffler 11 and the rear differential gear unit 13 and extends in the width direction of the vehicle so as to cover the space from the underside of the vehicle body. Namely, a small space whose bottom and sides are covered with the bent portion 27*a* of the suspension cross member 27 is created between the main muffler 11 and the rear differential gear unit 13. A plurality of links 23 (in FIGS. 1 and 2, only some are shown) extend sideways from both ends of the suspension cross member 27 in the width direction of the vehicle to the respective rear wheels 5 and support the rear wheels 5 so as to be vertically displaceable independently of each other, thereby suspending the rear wheels 5. Shock absorbers and spring members are not illustrated in the figures.

As shown in FIG. 1, a relay exhaust pipe 11*a* extends from one of the opposite ends of the main muffler 11 directed along the width of the vehicle, is bent in the form of the letter C along the side of the suspension cross member 27, and passes under the suspension cross member 27 toward the engine (not shown) located at the front part of the vehicle body. An exhaust pipe 11*b* for releasing exhaust into the atmosphere extends from the opposite end (other end) of the main muffler 11.

A fuel tank 31 (indicated by two-dot chain line) is installed, for example, between those portions of the side frames which are located more forward of the vehicle body than the rear differential gear unit 13.

A canister 33 for adsorbing (or desorbing) an evaporative gas of fuel within the fuel tank 31 is arranged at the rear part of the vehicle body configured as described above. The canister 33 comprises, for example, a first canister 35 (hereinafter merely referred to as the canister 35) having granular activated carbon (not shown) contained in a box-shaped case 35*a*, a second canister 37 (hereinafter merely referred to as the canister 37) having a honeycomb carbon filter (not shown) contained in a tubular case 37*a*, and a relay pipe 39 connecting the canisters 35, 37 to each other. Since the canister 33 is divided into two cases, its freedom of layout increases. A vent solenoid valve 41 for checking leak in the evaporative gas route and an air filter 43 are integrally attached to an outlet (not shown) of the canister 37, and the canister 37, the vent solenoid valve 41 and the air filter 43 are unified (assembled) into a unit.

Figure 3:
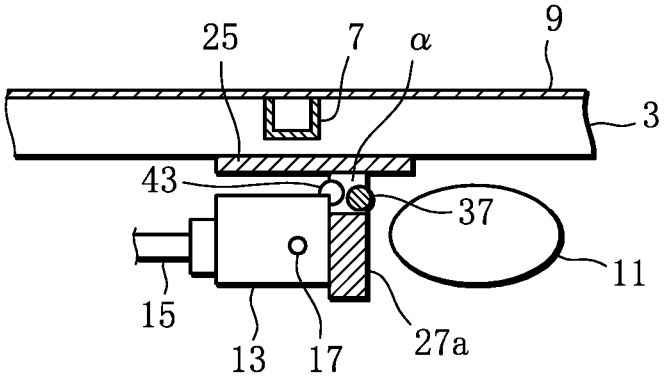
FIG. 3 is a side view as viewed from a direction indicated by an arrow A in FIG. 1.

The canister 33 is arranged in a region where the temperature of surrounding air is high within the rear part of the vehicle body. The installation structure of the canister 33 is illustrated in detail in FIGS. 3 to 5. FIG. 3 is a side view as viewed from a direction indicated by an arrow A in FIG. 1, FIG. 4 is a bottom view as viewed from a direction indicated by an arrow B in FIG. 1, and FIG. 5 is a rear view as viewed from a direction indicated by an arrow C in FIG. 1.

Figure 4:
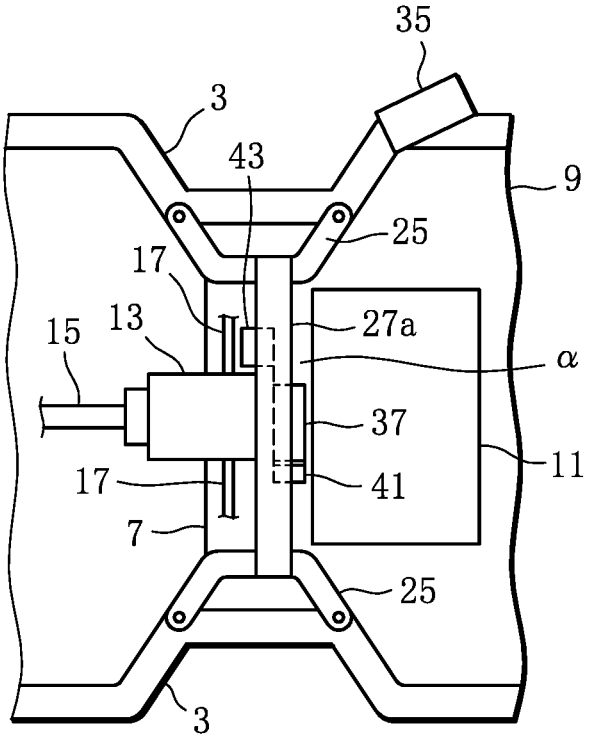
FIG. 4 is a bottom view as viewed from a direction indicated by an arrow B in FIG. 1.
Figure 5:
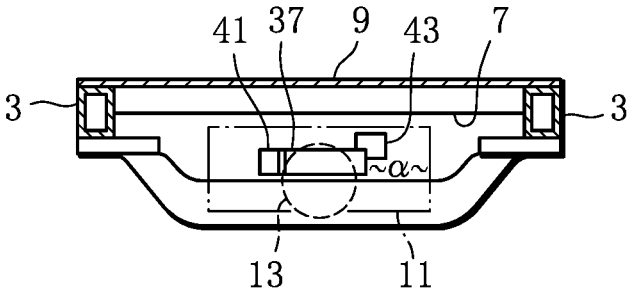
FIG. 5 is a rear view as viewed from a direction indicated by an arrow C in FIG. 1.

Specifically, as shown in FIGS. 1, 2 and 4, the canister 35 is attached to the underside of the rear portion of the side frame 3 at a location close to the main muffler 11, for example, close to the exhaust pipe 11*a*. The lower part of the canister 35 is covered with a protector member 45. The canister 35 is connected with a conduit member 47 (FIG. 1) that guides the evaporative gas of fuel within the fuel tank 31 to the canisters 35, 37, as well as a conduit member 49 (FIG. 1) that guides the evaporative gas adsorbed by the canisters 35, 37 to, for example, an intake manifold (not shown) of the engine.

In the rear frame structure of the vehicle body 1, the canister 37 is located in a region where heat is liable to accumulate. Specifically, as shown in FIGS. 3 to 5, the canister 37 is located in the aforementioned small space surrounded by the rear differential gear unit 13, the suspension cross member 27 and the main muffler 11, namely, in an underfloor region α underneath the floor panel 9.

More specifically, the canister 37 is disposed in the underfloor region α in a lateral orientation (along the width direction of the vehicle), for example, such that a major part of the canister 37, including the vent solenoid valve 41 and the air filter 43, overlaps with the suspension cross member 27. The temperature of the underfloor region α is liable to rise due to heat radiated from the main muffler 11 and the exhaust pipe 11*a* and heat radiated from the rear differential gear unit 13 (heat of the oil in the rear differential gear unit). Also, the underfloor region is a region where heat is liable to accumulate, so that the temperature of the air surrounding the canister 37 can be easily kept within a high temperature range. The canister 37 is fixed, together with the vent solenoid valve 41 and the air filter 43, to the cross member 7, the floor panel 9 or the like via a bracket 51 and an elastic member (not shown) in order to restrain vibrations accompanying the operation of the vent solenoid valve 41 from being transmitted to the vehicle body 1.

The relay pipe 39 connecting the canisters 35, 37 to each other is located right above a portion of the exhaust pipe 11*a* extending from the main muffler 11, and extends along the course of the exhaust pipe 11*a*. This permits the evaporative gas to be heated by the heat of the exhaust gas, that is, the temperature of the evaporative gas rises while the evaporative gas passes through the relay pipe 39.

The outlet of the air filter 43 is connected to a vent hose member 53 (FIG. 1), which extends toward the vicinity of the canister 35 and is connected to and opens into, for example, a feed pipe (not shown) that constitutes a fueling system of the fuel tank 31.

Thanks to the aforementioned installation structure of the canister 33, the evaporative gas within the fuel tank 31 is guided to the canister 35 and adsorbed by the activated carbon within the canister 35. The evaporative gas that failed to be adsorbed by the canister 35 is guided to the canister 37 through the relay pipe 39 and adsorbed by the honeycomb carbon filter of the canister 37. Air from which the fuel component of the evaporative gas has been removed is released into the feed pipe of the fuel tank 31 through the vent solenoid valve 41, the air filter 43 and the hose member 53.

The adsorbed evaporative gas is treated by introducing a negative pressure in the intake manifold (not shown) of the engine into the canisters 35, 37 to purge the activated carbon in the canister 35 and the honeycomb carbon filter in the canister 37 of the evaporative fuel such that the evaporative fuel is burned in the engine.

In the evaporative gas treatment system, the canisters 35, 37 are located near the main muffler 11, and therefore, the temperature of the activated carbon in the canister 35 and that of the honeycomb carbon filter in the canister 37 rise due to the heat received from the exhaust gas (engine) flowing through the main muffler 11.

Especially the canister 37 is disposed in the limited space covered on its front, back, bottom and lateral sides with the rear differential gear unit 13, the main muffler 11 and the suspension cross member 27 (rear suspension member), namely, in the underfloor region α, so that the temperature of the canister 37 rises significantly. Specifically, heat is radiated to the underfloor region α from the main muffler 11 (heat of the exhaust gas) and from the rear differential gear unit 13 (heat of the oil), with the result that the temperature of ambient air of the canister 37 rises to high temperatures. In addition, heat is liable to remain in the underfloor region α because the region α is surrounded by the rear differential gear unit 13, the main muffler 11 and the suspension cross member 27, so that the raised temperature can be kept easily.

As a consequence, the honeycomb carbon filter in the canister 37 can be efficiently heated by waste heat from the engine and the rear differential gear unit 13, allowing the temperature of the honeycomb carbon filter to rise effectively.

Thus, by making use of the rear part structure of the vehicle body, the temperature of the canister 37 can be raised sufficiently, so that the adsorption and desorption efficiency of the canister 37 can be heightened to a satisfactory extent. In addition, since the underside of the canister 37 is protected by the suspension cross member 27 (rear suspension member) that overlaps with the canister 37, the canister 37 can be prevented from being damaged by chipping (flying gravel) during travel of the automobile (motor vehicle).

Especially, the canister 33 is divided into the canister 35 and the canister 37 such that the one canister 37 is disposed in the underfloor region α, and this configuration can be easily adapted for increase in capacity. Moreover, the relay pipe 39 itself, which serves as a route connecting the canisters 35, 37 to each other, can store the evaporative gas, so that the configuration, though compact in structure, can be easily adapted for increase in the capacity of the canister 33.

Furthermore, the vent solenoid valve 41 is formed integrally with the canister 37, whereby leak gas is prevented from being released into the atmosphere.

In addition, since the relay pipe 39 is disposed so as to extend along a part of the exhaust pipe 11*a* of the main muffler 11, the evaporative gas is heated by the exhaust gas at a stage preceding the canister 37, making it possible to further enhance the efficiency of the honeycomb carbon filter of the canister 37. That is to say, the adsorption and desorption performance of the canister 37 can be improved by making full use of the vehicular rear part structure which is associated with a variety of restrictions.

The structures, combinations and the like of the individual elements of the aforementioned embodiment are illustrative only, and any addition, omission, replacement and other alteration of the structures may of course be made without departing from the scope of the present invention. Also, the present invention is not limited to the aforementioned embodiment, nor is it limited by the appended claims only. For example, in the foregoing embodiment, the canister is disposed in the underfloor region which is created by covering the space between the rear differential gear unit and the main muffler with the suspension cross member constituting the multi-link type rear suspension device. The suspension arrangement to which the present invention is applicable is not limited to such an arrangement, and the invention may be applied to an arrangement wherein a torsion bar, which is a suspension member of a rigid suspension device, passes between the rear differential gear unit and the main muffler. Also, in the above embodiment, the canister is divided into two and one divided canister is arranged in the underfloor region α. Alternatively, an undivided canister as a single unit may be disposed in the underfloor region α.

What is claimed is:

1. A canister installation structure in which a canister for adsorbing an evaporative gas of fuel in a fuel tank is arranged at a rear part of a vehicle body, wherein the rear part of the vehicle body includes a muffler arranged under a floor panel at a rear end of the vehicle body, a rear differential gear unit arranged under the floor panel at a location adjacent to the muffler in a longitudinal direction of the vehicle body, and a rear suspension member arranged below a cross member of the vehicle body so as to cover a space between the muffler and the rear differential gear unit from an underside of the vehicle body, and wherein the canister is disposed in an underfloor region above the rear suspension member and between the rear differential gear unit and the muffler in the longitudinal direction.

2. The canister installation structure according to claim 1, wherein the canister has a divided structure comprising a first canister connected to the fuel tank and a second canister connected to the first canister via a relay pipe, the first canister is disposed in a location adjacent the muffler but not in the underfloor region, and the second canister is disposed in the underfloor region.

3. The canister installation structure according to claim 2, wherein the muffler includes an exhaust pipe extending from the muffler, and the relay pipe is arranged so as to extend along a part of the exhaust pipe.

* * * * *